US008832862B1

(12) United States Patent
Solis

(10) Patent No.: US 8,832,862 B1
(45) Date of Patent: Sep. 16, 2014

(54) METHOD FOR MAKING AND USING A TORSO TOP OUTER GARMENT, AND RESULTING GARMENT

(76) Inventor: Gregory Solis, Jacksonville, FL (US)

( * ) Notice: Subject to any disclaimer, the term of this patent is extended or adjusted under 35 U.S.C. 154(b) by 94 days.

(21) Appl. No.: 13/424,781

(22) Filed: Mar. 20, 2012

Related U.S. Application Data

(63) Continuation-in-part of application No. 12/586,445, filed on Sep. 22, 2009, now abandoned.

(51) Int. Cl.
*A41D 7/00* (2006.01)

(52) U.S. Cl.
USPC ..... 2/67

(58) Field of Classification Search
USPC ..... 2/67, 69; 450/1, 73, 75, 88, 31, 32, 30, 450/41, 58
See application file for complete search history.

(56) References Cited

U.S. PATENT DOCUMENTS

| | | | | | |
|---|---|---|---|---|---|
| 1,254,043 | A * | 1/1918 | James | 450/31 |
| 1,868,741 | A * | 7/1932 | Gassel | 2/67 |
| 1,911,227 | A * | 5/1933 | Galligan et al. | 2/67 |
| 1,981,320 | A * | 11/1934 | Martin | 2/67 |
| 2,023,612 | A * | 12/1935 | Park et al. | 450/88 |
| 2,042,924 | A * | 6/1936 | Cunningham | 2/67 |
| 2,091,753 | A * | 8/1937 | Doctors | 450/73 |
| 2,338,535 | A * | 1/1944 | Pfleumer | 441/113 |
| 2,341,596 | A * | 2/1944 | Cobb | 2/67 |
| 2,437,541 | A * | 3/1948 | Koret | 450/71 |
| 2,458,696 | A * | 1/1949 | Elias | 450/78 |
| 2,466,638 | A * | 4/1949 | Denis | 450/58 |
| 2,484,467 | A * | 10/1949 | Schacht | 450/69 |
| 2,493,179 | A * | 1/1950 | Wittenberg | 450/32 |
| 2,592,265 | A * | 4/1952 | Fyffe | 450/41 |
| 2,611,130 | A * | 9/1952 | Engelman | 450/30 |
| 2,628,357 | A * | 2/1953 | Sider | 450/41 |
| 2,635,241 | A * | 4/1953 | Graf | 450/92 |
| 2,949,115 | A * | 8/1960 | Phillips | 450/58 |
| 4,289,137 | A * | 9/1981 | Dell et al. | 450/58 |
| 4,538,614 | A * | 9/1985 | Henderson | 450/70 |
| 4,797,954 | A * | 1/1989 | Williams et al. | 2/106 |
| 4,816,005 | A * | 3/1989 | Braaten | 450/58 |
| 4,955,846 | A * | 9/1990 | Greenberg | 450/69 |
| 5,664,257 | A * | 9/1997 | Hall | 2/69 |
| D396,541 | S * | 8/1998 | Lawrence | D2/709 |
| 5,823,851 | A * | 10/1998 | Dicker | 450/2 |
| 5,842,230 | A * | 12/1998 | Laudick | 2/69 |
| 5,871,388 | A * | 2/1999 | Lambert | 450/58 |
| 5,873,768 | A * | 2/1999 | Fleischman-Ament et al. | 450/19 |
| 5,944,579 | A * | 8/1999 | Fleischman | 450/69 |
| 6,165,045 | A * | 12/2000 | Miller et al. | 450/1 |
| 6,168,498 | B1 * | 1/2001 | Wagner | 450/58 |
| 6,572,437 | B1 * | 6/2003 | Waitz | 450/1 |
| 6,755,717 | B2 * | 6/2004 | Smith | 450/1 |
| 6,811,462 | B1 * | 11/2004 | Kenneally | 450/30 |
| 6,860,789 | B2 * | 3/2005 | Bell et al. | 450/20 |
| 7,144,294 | B2 * | 12/2006 | Bell et al. | 450/20 |
| 7,549,971 | B2 * | 6/2009 | Bell et al. | 602/75 |
| 7,922,682 | B2 * | 4/2011 | Bell et al. | 602/75 |
| 2004/0002288 | A1 * | 1/2004 | Bell et al. | 450/75 |
| 2006/0019576 | A1 * | 1/2006 | Bell et al. | 450/60 |

* cited by examiner

*Primary Examiner* — Richale Quinn
(74) *Attorney, Agent, or Firm* — Allen, Dyer, Doppelt, Milbrath & Gilchrist, P.A.

(57) ABSTRACT

A cover up torso top outer garment provides increased coverage and support for a woman wearing a bikini top, the garment formed of stretchable right and left breast portions with an open-ended front zipper releasably securing the breast portions, with elastic back and neck straps. The garment is donned over a bikini top, the zipper attaches the two breast portions together, and the straps are adjusted. The garment may then be doffed when appropriate to expose the bikini top.

9 Claims, 7 Drawing Sheets

METHOD FOR MAKING AND USING A TORSO TOP OUTER GARMENT, AND RESULTING GARMENT

CROSS REFERENCE TO RELATED APPLICATION

This application is a continuation-in-part of application Ser. No. 12/586,445 filed Sep. 22, 2009.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

This invention relates to a method for making and using an auxiliary torso top outer garment to be worn by women wearing revealing bathing suits, primarily bikinis.

2. Prior Art

Women that are fashionable and desirous of tanning much of their bodies when lying on the beach or poolside often wear bikini bathing suits to minimize tan lines on their backs, necks and elsewhere. This usually presents no problem when sitting or lying still on a towel or chaise lounge or the like. However, when bikini-clad women actively move about, playing volleyball, swimming, playing with and/or attending to children, where they may need to bend at the waist and/or crawl on the sand, fashionable bikini tops pose risks of the breasts dislodging from the bikini top or being overly exposed.

Currently, the available possible solution to this problem is to buy and wear a sports bra or triathlon styled top where the shoulder straps merge into a one piece central leg forming a "Y" shaped back member by which unwanted tan lines would be made on the back of a woman wearing same. Other sports bras have shoulder straps connected to a wide torso band at the back, which would be unwanted by a woman wearing a bikini top. Not only do sports bras cover too much of the torso, but the fabric is much thicker than bathing suit material and they are more binding and uncomfortable to wear. Also, to put on a sports bra over a bikini top while on the beach or at poolside presents some difficulties in properly positioning of the sports bra and the underlying bikini top.

Accordingly, this invention seeks to overcome the above problems by making and using a cover up in the form of an auxiliary torso top outer garment which is readily donned and doffed without the normal motions of the bikini top wearer in attempting to also put on a sports bra over the bikini top being worn. Women using the torso top outer garment of this invention will normally preset adjustable straps of the novel torso top outer garment in the privacy of their own home or hotel room, for example, over their bikini tops so that the auxiliary torso top outer garment can be preset and ready to be put on, much like a bolero or short jacket with a simple front closure, such as an open ended zipper.

Another feature of the method of making and using the auxiliary torso top outer garment of this invention is that it provides the wearer with comfort and support so that it may be worn comfortably for extended periods of time if necessary without detracting from the ability to obtain a tan over most of the back of the wearer and which looks more stylish than sports bras and can withstand repeated washings, wetting and drying substantially like a swimsuit.

SUMMARY OF THE INVENTION

The method of making and using a torso top outer garment in accord with this invention provides increased coverage and support for women wearing bikini bra swimsuits. The method comprises the steps of providing a garment having right and left breast-covering portions, respectively, each having a generally horizontal lower edge and a generally vertical edge extending perpendicular and upward from an end of said lower edge. The side front portions are made of a stretchable outer fabric that stretches vertically and horizontally and side front portions have a stretchable inner fabric that lines the outer fabric and also stretches vertically and horizontally. Both of the inner and outer fabrics are thin and readily dry after being wet.

The method includes fitting an open-ended front zipper of a predetermined length is attached to each of the right and left breast portions along the vertical edges for releasably securing the portions together. A length of elastic material of a predetermined width is disposed along each of the lower edges and located between the inner and outer fabric within a casing formed between the opposite ends of the lower edge and having a length shorter than the lower edge, the elastic material having ends secured to respective breast portions to provide gathers of the fabrics along the lower edge. Each of the breast portions is provided with a slightly curved elongated neck edge connected to respective upper ends of the vertical edges at one end of the neck edge and having another end spaced away a predetermined distance. Each of the breast portions is fabricated with a greater curved elongated arm edge with opposite ends one end thereof being adjacent another end of the neck edge and another arm edge end being adjacent another end of the lower edge. An elongated neck strap is connected to and spans between another end of the neck edge of the breast portions, and an elongated back strap is connected and spans between another end of the arm edge.

Other aspects of the invention are seen in the neck strap being adjustable in length and includes a length of elastic material. The neck strap carries a closed slide by which the elastic material is effectively shortened to substantially have overlapping parts and by which the elastic material is effectively lengthened to substantially have non-overlapping parts.

Additional aspects are provided by the back strap being adjustable in length and includes a length of elastic material. The back strap carries a closed slide by which the elastic material is effectively shortened to substantially have overlapping parts and by which the elastic material is effectively lengthened to substantially have non-overlapping parts.

Further aspects of the method includes forming attachment zones for securing the back strap by another end of the lower edge and another arm edge end of each of the side front portions. Attachment zones are formed for securing the neck strap by another end of the neck edge and the one end of the arm edge of each of the side front portions.

BRIEF DESCRIPTION OF THE SEVERAL VIEWS OF THE DRAWING

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE INVENTION

Figure 1:
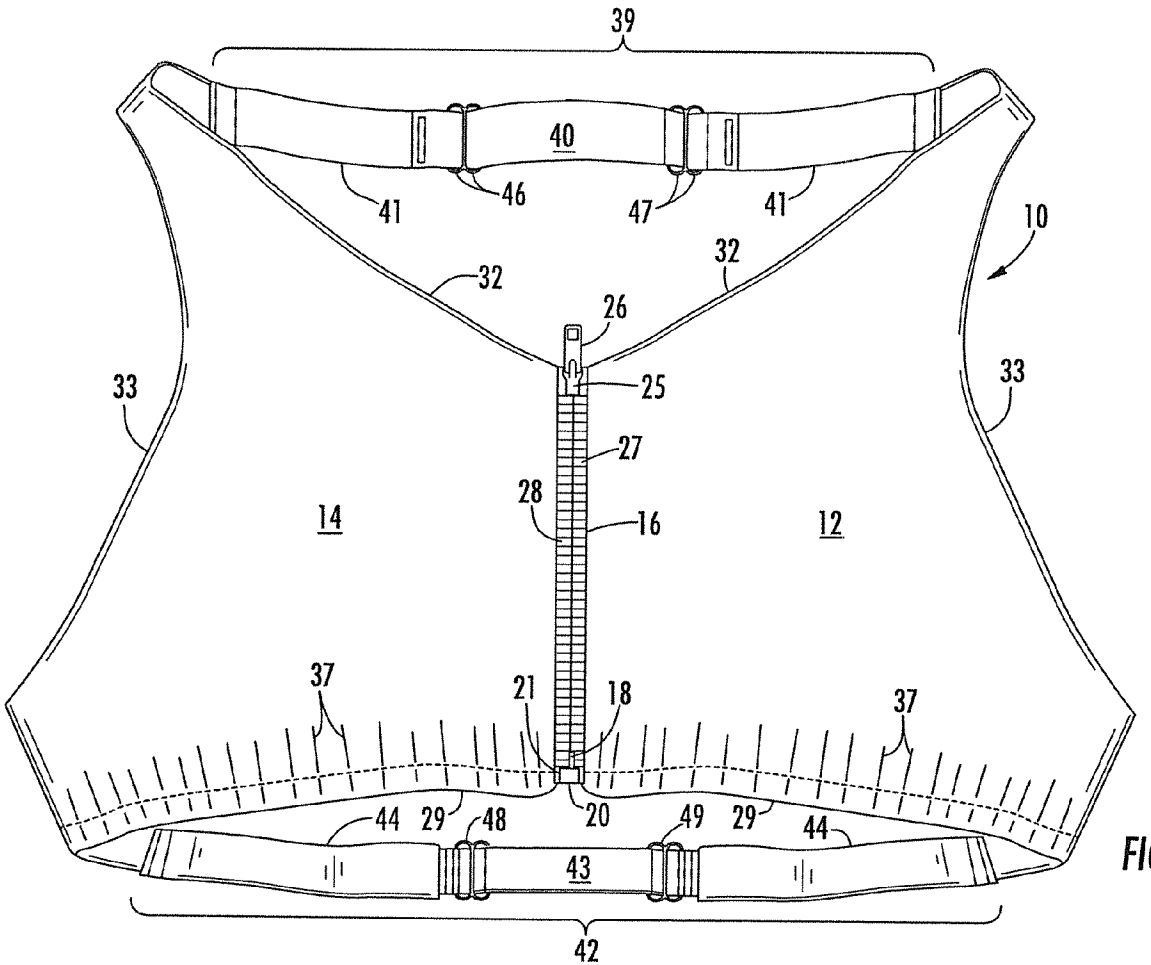
FIG. 1 is an outer front elevational view of the auxiliary torso top outer garment made in accord with the invention showing the open-ended front zipper, the adjustable neck strap and the adjustable back strap.
Figure 2:
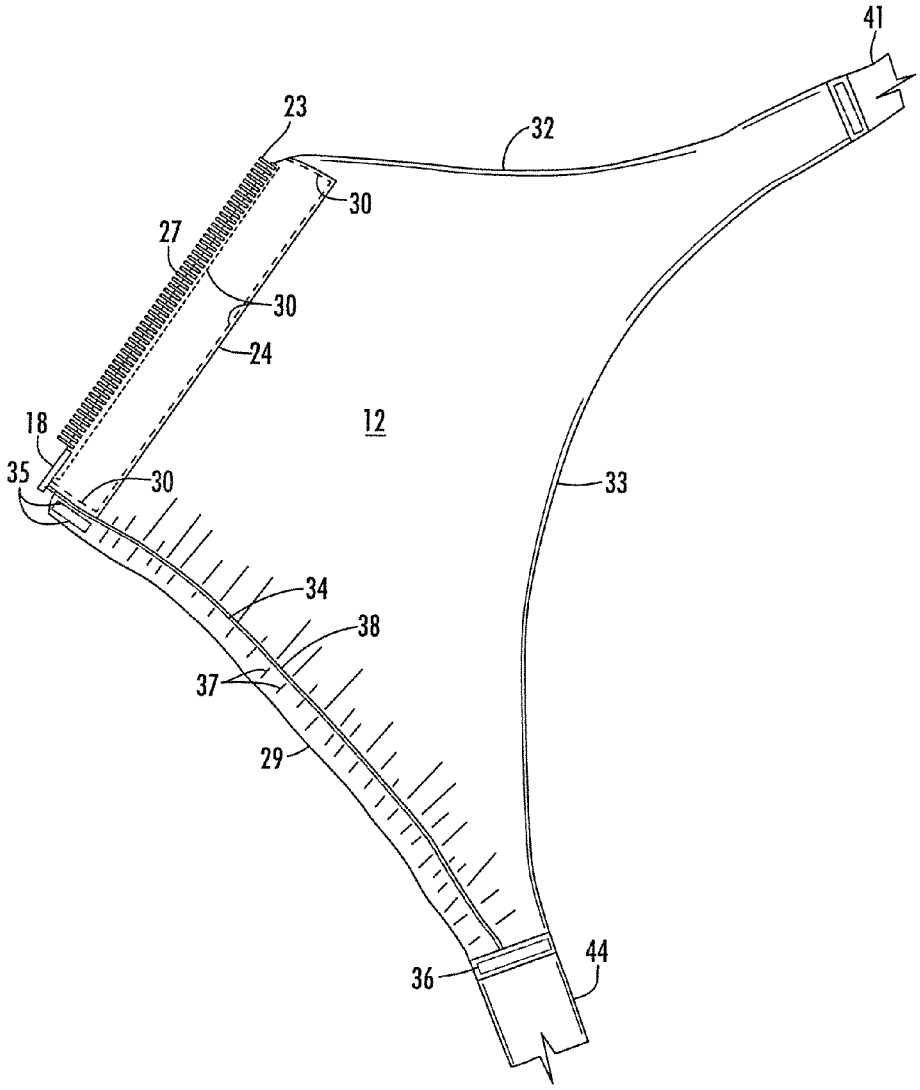
FIG. 2 is an inner front elevational view of the right side portion of the garment of FIG. 1, as viewed from inside the garment, without the neck and back straps.
Figure 3:
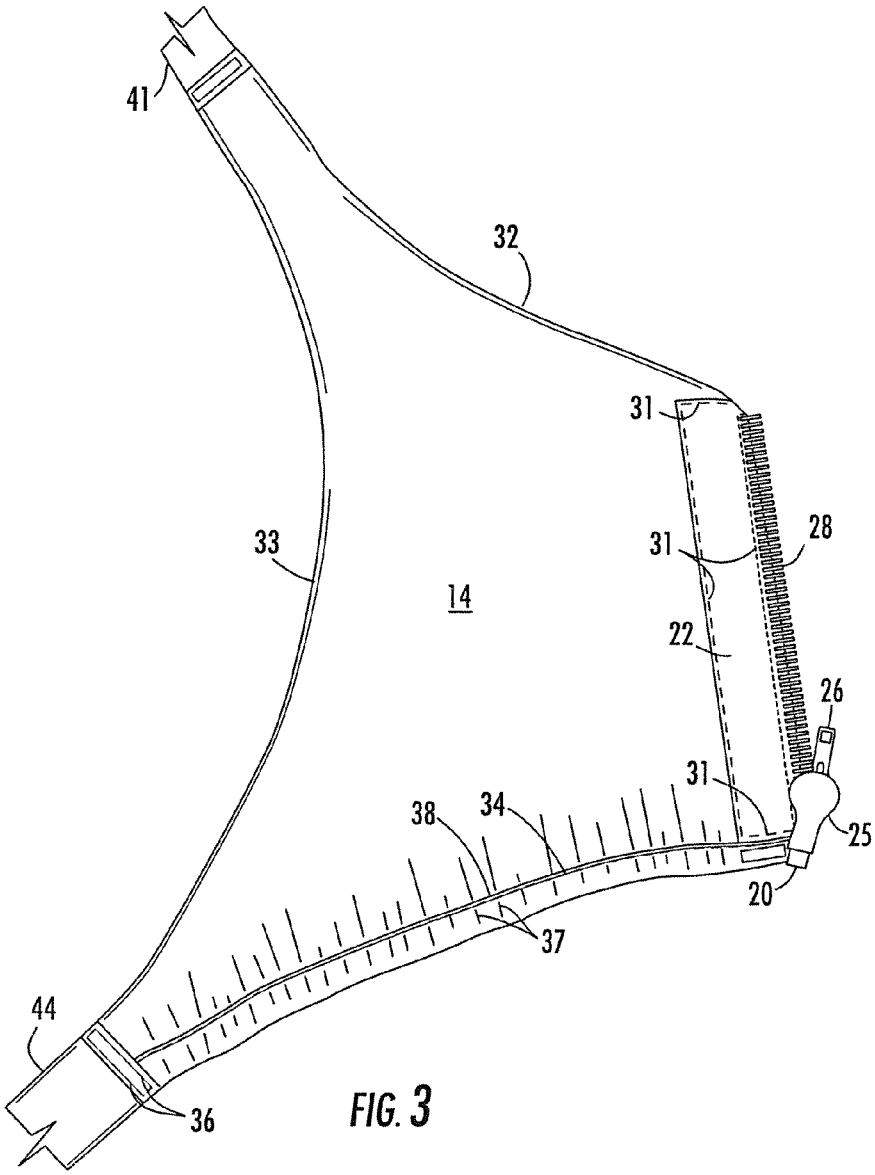
FIG. 3 is an inner front elevational view of the left side portion of the garment of FIG. 1, as viewed from inside the garment, without the neck and back straps.

An auxiliary torso top outer garment made and used in accord with this invention is generally designated by numeral 10 in FIG. 1, and includes a left breast portion 12 and a right breast portion 14 releasably secured together by an open-ended front zipper 16 having an insertion pin 18, a retainer box 20 mounted at the bottom 21 of one side of the zipper tape 22, as shown in FIG. 3. The top stop 23 is on one side of the zipper tape 24, as shown in FIG. 2, and is spaced from insertion pin 18. Stop 23 and pin 18 are disposed at opposite ends of the zipper tape 24, as sewn into the garment 10. The zipper slider 25 has a pull tab 26 movably connected to the slider 25 so that it may assume the position shown in FIG. 1 or be folded 180° downwardly to lie against the slider 25 and some of the interlocking fasteners 27 and 28 on respective tapes 24 and 22, all of which are well known to those having ordinary skill in the art.

The tapes 22 and 24 are sewn as depicted by broken lines 30 and 31 in respective FIGS. 2 and 3 to the completely lined bathing suit fabric of nylon Lycra spandex or the like which may be 80 or 90% nylon and 20 or 10% Lycra spandex and usually with four way stretch, as known in the art of swimsuits.

The upper edge 32 of each breast portion 12 and 14 has a shallow curve to form a U-neck or may be straighter to form a V-neck and has a length of about 7" to 8". The bottom edge 29 is gathered and has a length of about 9" to 10". The more deeply curved edge 33 is about 12" to 13". The breast portions 12 and 14 are sewingly connected to short casing end attachment zones 41 and 44 respectively, forming parts of neck strap 39 and back strap 42. Spanning between attachment zone 41 is an adjustable elastic strap 40 which is adjusted to the minimum length, as shown with the elastic being doubled, and may be adjusted to its maximum singled length by a closed slider 46, commonly found on adjustable bra shoulder straps and the like. Likewise, casing end attachment zones 44 of the back strap 42 are connected to doubled elastic 43 and the back strap 42 is provided with a closed slider 48.

A typical torso top outer garment when sewn in accord with this invention may have the following attributes:

A. zipper 16—length 5" to 6"

B. side breast portions 12 and 14 unstretched bottom length—9"
stretched bottom length—13"

C. elastic 34 width ½" sewn at ends by sew lines 35 and 36 to create gathers 37 in the casing 38 between the inner and outer fabric forming the fully lined garment D. unstretched upper edge 32 length—8"
stretched upper edge 32 length—11"

E. unstretched side curved edge 33 length—15"
stretched side curved edge 33 length—20"

F. neck strap 39 with unstretched elastic 40 doubled—12"
stretched elastic 40 doubled—16"
elastic 40 single stretched—21"
width of elastic 40—¾"

G. back strap 42 with unstretched elastic 43 doubled—11"
stretched elastic 43 doubled—16"
elastic 43 single stretched—22"

H. elastic 40 doubled about 3" and connected to end attachment zones 41 by respective closed slide 46 and side open slide 47

I. elastic 43 doubled about 3" and connected to end attachment zones 44 by respective closed slide 48 and side open slide 49

Preferably, the upper edge 32 of each breast portion 12 and 14 is provided with elastic sewn at ends by sew lines to create gathers in the casing between the inner and outer fabric forming the fully lined garment 10, in the same manner as the gathers 37. Likewise the curved edge 33 of each breast portion 12 and 14 is provided with elastic sewn at ends by sew lines to create gathers in the casing between the inner and outer fabric forming the fully lined garment 10.

It is to be understood that the width of the elastic in the gathers, including gathers 37, may be the same of differ to provide a comfortable fit around the breast of the wearer. Also, that the elastic may be the same or differ from the width of elastic 34 and/or may be pre-stretched differently from the stretching of elastic 34 within its casing 38.

Sliders 47 and 49 may be closed sliders like sliders 46 and 48, or may be one side open sliders so that each or either of the neck strap 39 and back strap 42 may be opened to provide even greater versatility for the user in properly presetting the garment 10 in privacy.

With the above attributes, the drawings and the description, a person having ordinary skill in the sewing arts and particularly in the swimsuit sewing arts would be able to cut out, assemble and sew the auxiliary torso top outer garment 10 of this invention. It is intended that perhaps only two or perhaps three different sizes would be needed to adequately fit most women in a supportive and comfortable manner, such as, Small-Medium,
Large-Extra Large, and
2×-3×.

The various adjustable features of the straps 39 and 42 and the stretchability of not only the elastics 40 and 43 (and 34) but the stretchability of the entire side breast portions 12 and 14 and casing attachments 41 and 44, provide the garment with the ability of proper fitting of most women's upper torso over bikini tops.

Figure 4A:
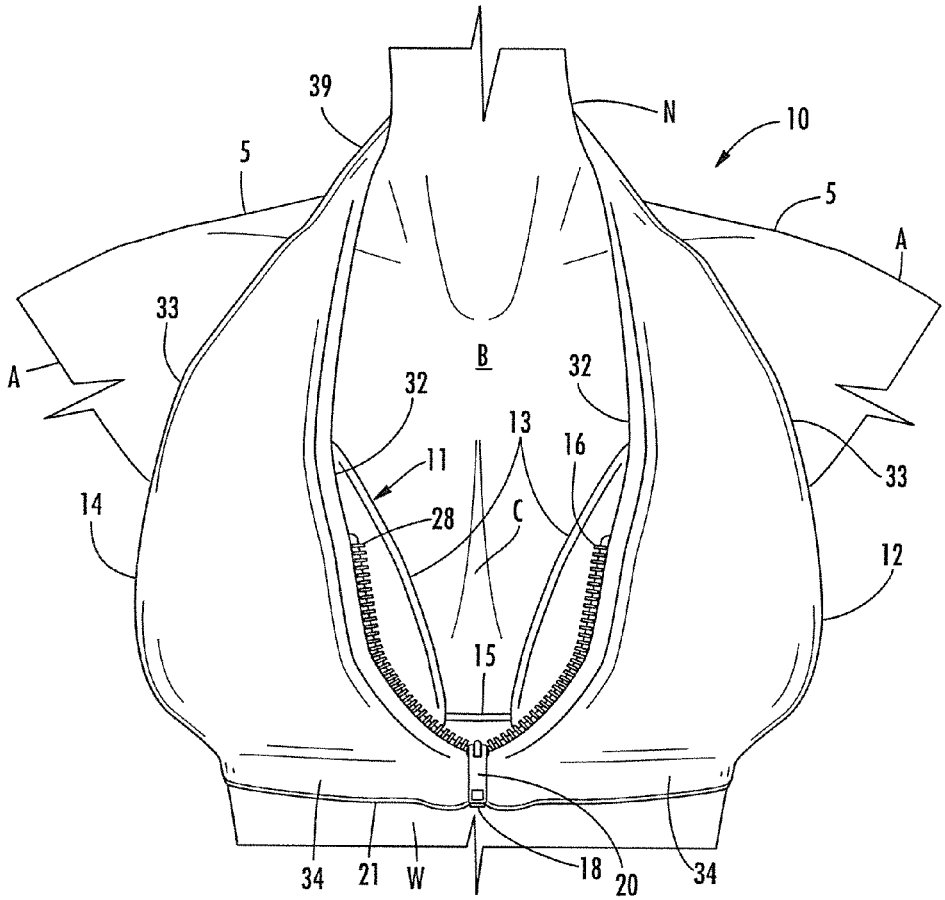
FIGS. 4A and 4B are front views and FIG. 4C is a back view illustrating the use of an auxiliary torso top outer garment made according to this invention in use over a bikini top.
Figure 4B:
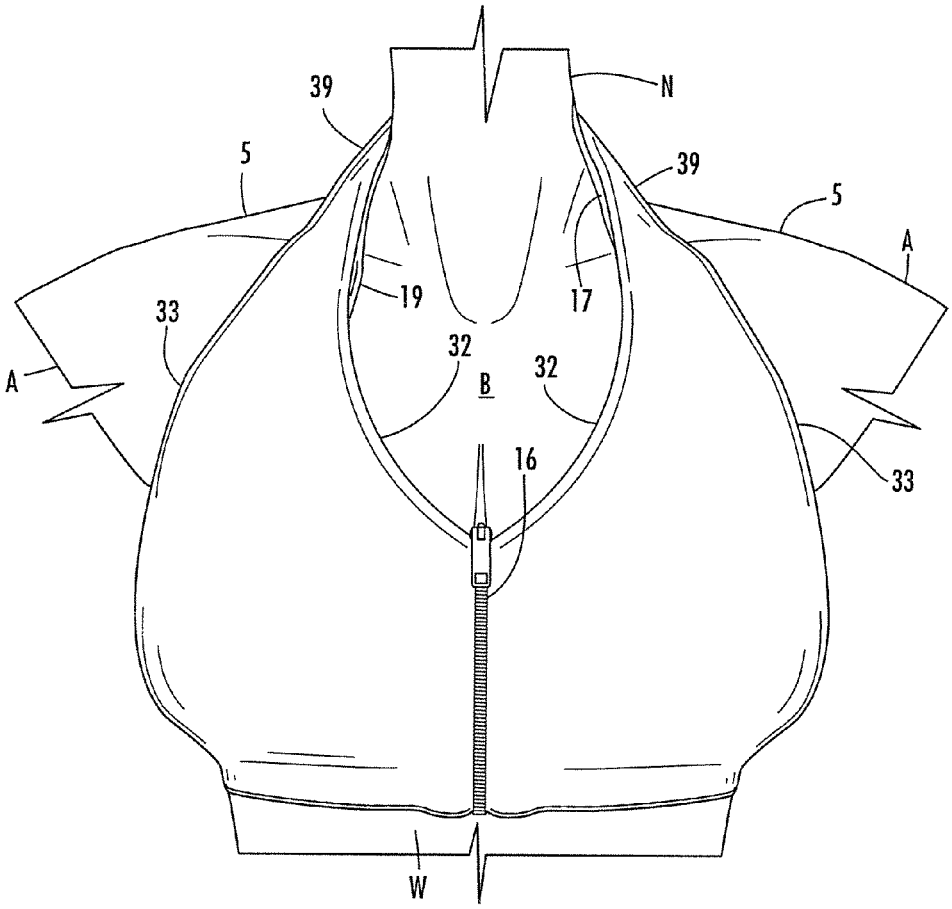
Figure 4C:
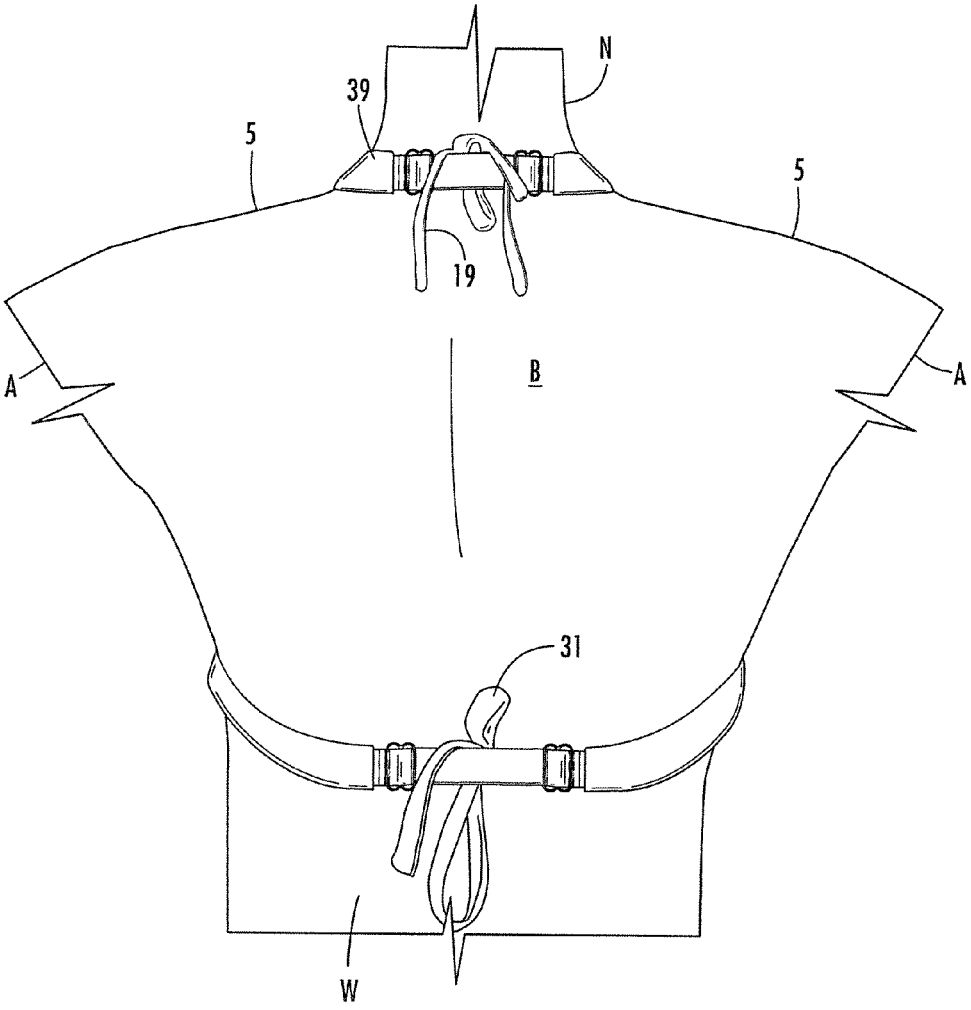

Referring to FIGS. 4A, 4B and 4C, as hereinbefore mentioned, the auxiliary torso top outer garment 10 will normally be adjusted to fit over a bikini 11 on the body B of the bikini top wearer at the house or hotel prior to going to the beach or pool. The bikini 11 typically comprises two breast covers 13, a clasp 15 holding the two covers 13 together at the bottom of the user's cleavage C, and neck and waist ties 19 and 21, respectively. She will doff the torso top outer garment 10 from her body B after adjustments of the neck strap 39 and the back strap 42 and will then be ready to go to the beach or pool wearing her bikini bathing suit 11, perhaps exposing more of her skin, as many bikini tops do. Before swimming or playing volleyball, or running or overly bending or playing with or attending to her children, she will don the auxiliary torso top outer garment 10, to neatly and comfortably cover more of her breasts and more effectively support and maintain the breasts inside the torso top 10 even if the breasts somehow "pop out" from the bikini top 11 she is wearing. Likely this would not occur if the wearer properly adjusts the auxiliary torso top outer garment 10 before she wears it over her bikini top 11. This will be further appreciated by a comparison of FIGS. 4A and B. In FIG. 4A, the garment 10 is shown with the zipper 16 engaged in only slightly zipped up below the clasp 15, and with a portion of the outer garment 10 extending below the bottom of the bikini breast covers 13. Thereafter, as the zipper is continued upward (FIG. 4B), the wearer's cleavage C is completely covered and any inadvertent dislodgement is avoided entirely.

Figure 5:
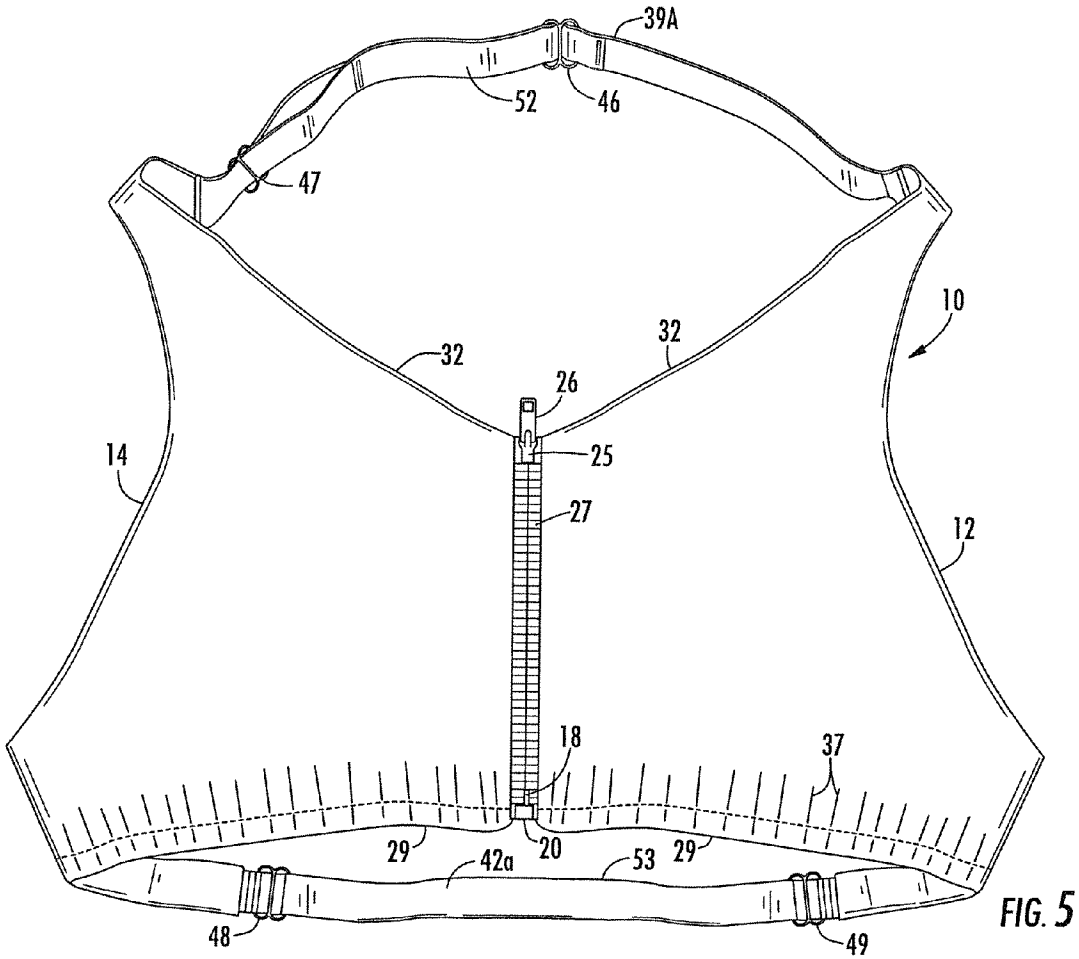
FIG. 5 is an outer front elevational view of another embodiment of the auxiliary torso top outer garment made in accord with this invention, with modified adjustable neck and back straps.

FIG. 5 depicts an alternate embodiment with most of the same components identified by the same numerals. The casing attachments 41 and 44 are substantially shortened or eliminated so that longer elastics 52 and 53 primarily and respectively form substantially the entire neck strap 39A and back strap 42A, as shown. Each of those straps 39A and 42A have corresponding respective closed slides 46, 47, 48 and 49 which function in the same manner as heretobefore described. This embodiment, while perhaps being more easily sewn and less costly, is not as comfortable to the wearer, as the embodiment of FIGS. 1-3.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A method for making and using a torso top outer garment for providing increased coverage for a woman wearing a bikini top, the method comprising the steps of:

forming right and left breast portions, each having a generally horizontal lower edge and a generally inner vertical edge extending perpendicular and upward from an inner end of the lower edge;

making the right and left breast portions of a stretchable outer fabric that stretches vertically and horizontally and readily dries after being wet, and with a stretchable inner fabric lining that stretches vertically and horizontally and readily dries after being wet;

attaching a front zipper along the inner vertical edges of each right and left breast portions for releasably securing the breast portions together;

fitting a length of elastic material of a predetermined width along each of the lower edges of each breast portion and located between the inner and outer fabrics within a casing between the opposite ends of the lower edge and having a length shorter than the lower edge, with the elastic material having ends secured to the breast portions providing gathers of the inner and outer fabrics along the lower edge;

providing each of the breast portions with a slightly curved elongated neck edge connected to respective upper ends of the vertical edges at one end of the neck edge and having another end spaced away a predetermined distance;

providing each of the breast portions with a greater curved elongated arm edge having opposite ends with one end thereof being adjacent another end of the neck edge and another arm edge end being adjacent another end of the lower edge;

connecting and spanning an elongated neck strap between the another end of the neck edges of the breast portions;

connecting and spanning an elongated back strap between the another end of the arm edges of the right and left breast portions; and dimensioning the right and left breast portions and the neck and back straps so that the outer garment easily fits over a bikini top when donned by the woman with the zipper unzipped and then fits snugly over the bikini top of the woman when the zipper is zipped.

2. The method recited in claim 1 wherein the method further comprises the step of dimensioning the lower edge of the right and left breast portions to extend below the bikini top.

3. The method recited in claim 1 further comprising the step of forming gathers along the elongated arm edge of each breast portion.

4. The method recited in claim 1 wherein the method further comprises the step of forming the casing as an overlap across the lower edge of the inner fabric lining.

5. The method recited in claim 1 wherein the method further comprises the step of fitting the front zipper to each of the right and left breast portions along the inner vertical edges with a zipper having an insertion pin fitted at the lower edge of the outer garment.

6. The method recited in claim 1, further comprising the step of doffing the garment by unzipping the zipper and removing the breast portions of the garment from the woman while leaving the bikini top in place.

7. The method recited in claim 1, further comprising the step of selecting the stretchability of the breast portions and the adjustability of the back and neck straps so that the garment can be donned over the bikini top.

8. The method recited in claim 1, further comprising the step of dimensioning the breast portion of the garment so as to extend below the bikini top.

9. The method recited in claim 8, further comprising the step of dimensioning the breast portions of the garment so as to extend above the bikini top.

* * * * *